US009440130B2

(12) United States Patent
Dai

(10) Patent No.: US 9,440,130 B2
(45) Date of Patent: Sep. 13, 2016

(54) SHUTTLECOCK AND MANUFACTURING METHOD THEREOF

(71) Applicant: Jianlin Dai, Maanshan (CN)

(72) Inventor: Jianlin Dai, Maanshan (CN)

( * ) Notice: Subject to any disclaimer, the term of this patent is extended or adjusted under 35 U.S.C. 154(b) by 0 days.

(21) Appl. No.: 14/361,297

(22) PCT Filed: Nov. 26, 2012

(86) PCT No.: PCT/CN2012/085241

§ 371 (c)(1),
(2) Date: May 28, 2014

(87) PCT Pub. No.: WO2013/078972

PCT Pub. Date: Jun. 6, 2013

(65) Prior Publication Data

US 2014/0335980 A1 Nov. 13, 2014

(30) Foreign Application Priority Data

Nov. 28, 2011 (CN) ..... 2011 1 0418704
Nov. 28, 2011 (CN) ..... 2011 1 0418724
Nov. 28, 2011 (CN) ..... 2011 1 0418741
Nov. 28, 2011 (CN) ..... 2011 1 0426157

(51) Int. Cl.
*A63B 67/18* (2016.01)

(52) U.S. Cl.
CPC ..... *A63B 67/18* (2013.01); *A63B 67/187* (2016.01); *A63B 67/19* (2016.01)

(58) Field of Classification Search
CPC ..... A63B 67/18
See application file for complete search history.

(56) References Cited

U.S. PATENT DOCUMENTS 1,620,922 A * 3/1927 Saunders ..... A63B 67/18 473/579
2,025,325 A * 12/1935 Bauer ..... A63B 67/18 473/580
2,093,301 A * 9/1937 Bauer ..... A63B 67/18 29/592
2,666,643 A * 1/1954 Miller ..... A63B 67/18 473/580
2,757,932 A * 8/1956 Shaw ..... A63B 67/18 446/400
2,860,879 A * 11/1958 Carlton ..... A63B 67/18 473/579
3,752,479 A * 8/1973 Chung ..... A63B 67/18 473/580

* cited by examiner

*Primary Examiner* — John Ricci
(74) *Attorney, Agent, or Firm* — Raymond Y. Chan; David and Raymond Patent Firm

(57) ABSTRACT

A shuttlecock includes: a set of feather units, a shuttlecock head, and a connecting arrangement which including a feather planting arrangement. The feather planting arrangement includes a set of feather planting members of the same number as the number of the feather units, each feather planting member has a feather planting end portion and an insertion end portion, a shaft member of each feather unit is inserted in the feather planting end portion while the insertion end portion of each feather planting member is inserted in the shuttlecock head. Further disclosed is a method of manufacturing the shuttlecock.

6 Claims, 18 Drawing Sheets

SHUTTLECOCK AND MANUFACTURING METHOD THEREOF

NOTICE OF COPYRIGHT

A portion of the disclosure of this patent document contains material which is subject to copyright protection. The copyright owner has no objection to any reproduction by anyone of the patent disclosure, as it appears in the United States Patent and Trademark Office patent files or records, but otherwise reserves all copyright rights whatsoever.

BACKGROUND OF THE PRESENT INVENTION

1. Field of Invention

The present invention relates to a shuttlecock and a manufacturing method thereof, and more particularly to a shuttlecock comprising a connecting apparatus for coupling a shuttlecock head with a set of feather units, and its manufacturing method.

2. Description of Related Arts

Badminton is a beneficial racquet game for exercising, and since there is no intensive physical contact, it is suitable for people of all ages. However, the sports sites, the supporting facilities, and the manufacturing process of the shuttlecocks still restrict the development of the game, and thus result in a relatively low penetration rate of the game.

In addition, when manufacturing a shuttlecock in a conventional process, sixteen natural feathers are subject to a simple preparing process so that they substantially have a same length and a same shape, then these natural feathers are inserted into a shuttlecock head. In order to ensure the flying stability of the shuttlecock, all of the feathers of the shuttlecock are required to have a good consistence. As we all know, a feather comprises two parts which are the shaft portion and the feather portion. The so-called consistence of the feather requires the length, the degree of curvature, the degree of arch, the toughness, and the thickness of the shaft portions to be consistent, as well as requiring the shape, size, and color of the feather portions to be consistent. Through tailoring and selecting process, it is available to make the shape, size, and color of the feather portions be consistent. However, it is not likely to make the shaft portions of the feathers of the shuttlecock be consistent. That is because the feathers are natural feathers, so even the feathers are obtained from a same goose or duck, it is not likely to make the gradually decreasing rate of the length, the degree of curvature, the degree of arch, the toughness, and the thickness of all shaft portions be consistent, so that it is not possible to obtain consistent shaft portions of the feathers. Therefore, since the material for manufacturing a shuttlecock is not able to provide feathers with shaft portions of good consistence, there is an inevitable disadvantage for the conventional shuttlecock that that the flying stability is not good.

Because the quality of the goose feathers are better than the quality of the duck feathers, particularly, the shaft portions of goose feathers, which have relatively strong toughness, are not easy to fracture, while the shaft portions of duck feathers, which have relatively weak toughness, are easy to fracture, so that the durability of the shuttlecocks made of goose feathers is better than the durability of the shuttlecocks made of duck feathers. Furthermore, the period for raising ducks from eggs to be mature for harvesting feathers is about ninety days, but the period for a goose is about one hundred and twenty days, so that the costs for manufacturing shuttlecocks made of goose feathers and are of good quality are relatively high.

Additionally, in order to ensure that the shuttlecocks are able to fly in a spinning manner, all of the feathers are inserted into the shuttlecock head side by side in a staggered manner so that all of the feathers are constructed to be vortex-shaped. In other words, each of the feathers is arranged to have an eccentric angle, and each two adjacent feather portions of the feathers define a gap therebetween. In order to ensure that the shuttlecock is able to fly stably, all of the gaps are preferred to have a same size and distance. In a conventional shuttlecock, since the shaft portions of the natural feathers are directly inserted in the shuttle head, the insertion holes in the shuttlecock head are not easy to be constructed to have a shape matching the shape of the shaft portions of the feathers, the eccentric angles of the insertion holes are even harder to be arranged correctly, so that the eccentric angle of each of the feathers is hard to control, and thus the eccentric angles varied to a large extent, and result in a weak flying stability of the shuttlecocks.

Furthermore, as mentioned above, since it is impossible to keep the toughness, thickness, and curvature of the shaft portions of all feathers of a shuttlecock to be consistent, when the shuttlecock is applied with a strong impact force via a shuttlecock racket, the force is not distributed consistently along each shaft portion, so that not only the flying stability of the shuttlecock is influenced, but also the shaft portions are easy to fracture. Once the shaft portions are damaged, the whole shuttlecock cannot be used.

In addition, a quality test should be carried out when the shuttlecocks finish the manufacturing process. The test introduces a testing device to violently strike the shuttlecocks, and the impact force is larger than the force of a common user when striking the shuttlecocks, so that because the shaft portions are not able to be consistent, many shuttlecocks fracture after striking by the testing device, for the shaft portions of the feathers are not evenly applied with the impact force. Therefore, many shuttlecocks are abandoned before selling into the market for using. Thus, not only the production rate of the shuttlecocks is relatively low, but also it results in a large waste, and the manufacturing costs of the shuttlecocks are relatively high.

In a word, the output of the feathers is limited, and the natural feathers are not replaceable, so that the output of the conventional shuttlecocks is limited. And because the natural feathers have a bad consistence, especially it is hard to meet the requirement of the consistence of the thickness, curvature, and toughness of the shaft portions of the all feathers of the shuttlecock, the quality of the most conventional shuttlecocks is not good, and thus the price of the shuttlecocks of good quality is relatively high, so that the penetrate rate of badminton is influenced.

In order for better understanding the influence of the conventional shuttlecocks on badminton, the structure of the conventional shuttlecocks and manufacturing method thereof are illustrated in the following description. Referring to FIG. 1 of the drawings, a conventional shuttlecock is illustrated. The conventional shuttlecock comprises a shuttlecock head 10', a set of feather 30' inserted into the shuttlecock head 10', and a connecting string 40' for connecting and fixing the set of feather 30'. The number of the feathers 30' is sixteen, the length of the each feather 30' is 62-77 mm. Each feather 30' has a shaft portion 31' and a feather portion 32' which has a length about 35-40% of the total length of the entire feather. The lower portion of each feather 30' is inserted into the outer circumference of the shuttlecock head 10', and is further fixed and retained in position by glues, the upper portion of each feather 30' is connected and fixed by the connecting string 40', so that all of the feathers 30' are connected to form a one-piece structure, so as to ensure that the feathers 30' can evenly withstand the impact force of the shuttlecock racket, so that the flying stability of the shuttlecock is improved. However, once one of the shaft portions 31' fracture, since it is replaceable, the whole shuttlecock cannot be used.

Referring to FIG. 2 of the drawings, the connecting string 40' connects the shaft portions 31' of the sixteen feathers 30' in series manually by human hands in a staggered and twisted manner, and then the binding positions between the connecting string 40' and each shaft portion 31' is provided with glues for enhancing the stability of the connection in series therebetween. As is well known in the art, there is a problem that it is difficult to ensure a same angle between each two adjacent shaft portions 31' when connecting the shaft portions 31' of the feathers 30' in series manually by human hands in a staggered and twisted manner. Therefore, not only the flying stability of the shuttlecock is influenced, but also some of the shaft portions 31' will fracture for the shaft portions 31' are not able to evenly distribute impact force when the shuttlecock is under a strike.

The method for manufacturing the conventional shuttlecock comprises the following steps.

(1) Select and tailor sixteen feathers 30' which fit predetermined requirements, each feather 30' has a length of 62-77 mm and includes a shaft portion 31' and a feather portion 32', wherein a length of the feather portion 32' is 35-40% of the length of the entire feather, all of the feathers of the shuttlecock have a same length and each shaft portion 31' has a same length. Most importantly, the shaft portions 31' of the sixteen feathers of the shuttlecock should be consistent. Not only each shaft portion should have a same length, the toughness, curvature, and the thickness of each shaft portion should be substantially the same.

(2) Insert the shaft portions 31' of the sixteen feathers 30' into insertion grooves 11' of the shuttlecock 10' one by one.

(3) Connect the shaft portions 31' of the sixteen feathers 30' in series manually by human hands in a staggered and twisted manner by the connecting string 40'. Generally, this step will be repeated twice. In other words, two connecting strings 40' are required to connect the shaft portions 31' on different sites.

(4) Apply glues to the binding positions between the shaft portions 31' and the shuttlecock head 10', and the binding positions between the shaft portions 31' and the connecting string 40', so that the shaft portions 31' is engaged with the shuttlecock head 10' and the connecting string 40' more stably, so that the feathers 30', the shuttlecock head 10', and the connecting string 40' form an integral structure.

The above mentioned manufacturing method of the conventional shuttlecocks is mainly carried out by manual operations, so that there are several disadvantages. First of all, in the above step (1) for selecting and tailoring sixteen feathers 30' which fit predetermined requirements, the main object of this step is to ensure that the shaft portions of the sixteen feathers of the shuttlecock have a good consistence. In other words, the toughness, curvature, and thickness of the shaft portions of the sixteen feathers should be the same, but the whole selecting process is competed based on the experience and sensibility of the worker, so that it is difficult to ensure that the shaft portions of the sixteen feathers of the shuttlecock have a good consistence, and thus the quality of the shuttlecock cannot be guaranteed. Secondly, in the above step (3) for connecting the shaft portions 31' in series via the connecting string 40', the angle between adjacent two shaft portions is hard to control, and the angle between each shaft portion 31' and the shuttlecock head 10' is also hard to control. In other words, the taper rate of the shuttlecock is hard to control. Thirdly, in the step (4), the amount of the glues cannot be controlled, usually resulting in an overweight of the shuttlecocks, so that the shuttlecocks cannot meet the standard requirements of the badminton matches. Fourthly, in the step (4), although the glues applied on the binding positions between the shaft portions 31' and the shuttlecock 10', and the binding positions between the shaft portions 31' and the connecting string 40' is beneficial for enhancing the engagement therebetween. However, because of the introduction of the glues, the part of the shaft portion applied with glues have a stiffness larger than the rest part of the shaft portion without glues, particularly the binding positions between the shaft portion and the connecting string may result in a relatively large stiffness, so that when the shuttlecock is under a strike by a shuttlecock racket, the shaft portions may fracture from the binding positions at the connecting string 40'. However, once one of the shaft portions fractures, the whole shuttlecock cannot be used. Fifthly, in order to keep the angle between two adjacent feathers to be the same, after using the connecting string 40' to connect the shaft portions 31' in series, not only the binding positions between the connecting string 40' and each shaft portion 31' are applied with glues, but also the whole connecting string 40' is applied with glues, so that the connecting string 40' is solidified to provide a support for the shaft portions 31', so as to prevent the angle between the two adjacent shaft portions 31' to vary during the flying of the shuttlecock to influence the flying stability of the shuttlecock. However, the amount of the glues is hard to control, when excess amount of the glues is applied, the resulting shuttlecock may be overweight, when the amount of the glues is not enough, the solidifying performance of the connecting string 40' is not good. In addition, evenly applying the glues is also a problem for the operations are carried out based on the experience of the workers, so that the quality of the shuttlecocks may vary depending on the experience of the workers.

In a word, the efficiency of conventional method for manufacturing a shuttlecock is relatively low, and the requirement for the experience of the workers is relatively high, so that the manufacturing process cannot be standardized, and thus the quality of the conventional shuttlecocks is far from satisfied. Once the shaft portions fracture, the whole shuttlecock cannot be repaired, so that it results in a large waste.

SUMMARY OF THE PRESENT INVENTION

A main object of the present invention is to provide a shuttlecock, wherein the shuttlecock is adapted for reducing the amount of natural feathers used for producing the shuttlecock, and increasing the utilization rate of the feathers.

Another object of the present invention is to provide a shuttlecock, wherein the flying stability of the shuttlecock is better than the flying stability of conventional shuttlecocks.

Another object of the present invention is to provide a shuttlecock, wherein the shuttlecock comprises a set of feather planting members for replacing the section of shaft portion at the lower side of the feather of the conventional shuttlecock. Since the roughness, curvature, and thickness of the feather planting members can be controlled via the manufacturing mold during the production process by the manufacturers, the influence of the difference between the shaft members of the natural feathers on the flying stability of the shuttlecock can be reduced. In addition, the material of the feather planting members can be selected to be plastic material having a good roughness, so that the feather planting members can withstand a larger impact than the shaft portions of the natural feathers, so that the feather planting members are not easy to fracture when the shuttlecock is under a strike, and thus not only the quality of the shuttlecock is enhanced, the lifespan of the shuttlecock is prolonged.

Another object of the present invention is to provide a shuttlecock, wherein when the shaft members of the feathers fracture, it is convenient to replace with a new feather, so that the lifespan of the shuttlecock is prolonged, and the waste is prevented.

Another object of the present invention is to provide a shuttlecock, wherein the connecting members of the feather planting arrangement is inserted into the shuttlecock head, so as to prevent the feather being directly inserted into the shuttlecock similar to the prior art and result in a hollow core of the shuttlecock head, and thus the risk of the shuttlecock being smashed is reduced, and the lifespan of the shuttlecock is prolonged.

Another object of the present invention is to provide a shuttlecock, wherein when the length of the feather member of the feather is the same as the length of the feather portion of the feather of a natural shuttlecock, the length of the shaft member of the feather of the shuttlecock of the present invention is only 15-25% of the total length of the feather. In other words, the feather used for manufacturing the shuttlecock of the present invention is shorter than the feather used for manufacturing the conventional shuttlecock. More specifically, the shaft member of the feather of the present invention is shorten than the shaft portion of the feather of the conventional shuttlecock, so that the risk of the difference between shaft members of the natural feathers resulting in the low quality of the shuttlecock is reduced. In addition, the utilization rate of the feathers is significantly increased, and the manufacturing costs are reduced.

Another object of the present invention is to provide a method for manufacturing a shuttlecock, wherein the method for manufacturing the shuttlecock is greatly simplified in comparison with the conventional manufacturing methods, so that the manufacturing costs are reduced.

Another object of the present invention is to provide a method for manufacturing a shuttlecock, wherein the quality of the shuttlecock manufactured by the present invention is better than the conventional shuttlecock.

Another object of the present invention is to provide a method for manufacturing a shuttlecock, wherein the shuttlecock manufactured by the present invention has a lower reject rate than the conventional shuttlecock.

Another object of the present invention is to provide a method for manufacturing a shuttlecock, the requirement for experience and capability of the manufacturer of the present invention is lower than the requirement for the manufacturer of the conventional shuttlecock, while the quality of the shuttlecock is still guaranteed.

Additional advantages and features of the invention will become apparent from the description which follows, and may be realized by means of the instrumentalities and combinations particular pointed out in the appended claims.

According to the present invention, the foregoing and other objects and advantages are attained by a shuttlecock, comprising: a set of feather units each comprising a feather member and a shaft member extended from the feather member, a shuttlecock head having at least one insertion groove, and a connecting arrangement, wherein the shaft member of each feather unit is planted at the connecting arrangement, and the connecting arrangement is planted in the insertion groove of the shuttlecock head.

In addition, the present invention further provides a method for manufacturing a shuttlecock, wherein the method comprises the following steps.

(a) Provide a set of feather units.

(b) Plant the set of feather units at the connecting arrangement.

(c) Connect the connecting arrangement with a shuttlecock head.

In the above method, the order of the steps (b) and (c) can be reversed.

Still further objects and advantages will become apparent from a consideration of the ensuing description and drawings.

These and other objectives, features, and advantages of the present invention will become apparent from the following detailed description, the accompanying drawings, and the appended claims.

DETAILED DESCRIPTION OF THE PREFERRED EMBODIMENT

The following description is disclosed to enable any person skilled in the art to make and use the present invention. Preferred embodiments are provided in the following description only as examples and modifications will be apparent to those skilled in the art. The general principles defined in the following description would be applied to other embodiments, alternatives, modifications, equivalents, and applications without departing from the spirit and scope of the present invention.

Embodiment 1

Figure 1:
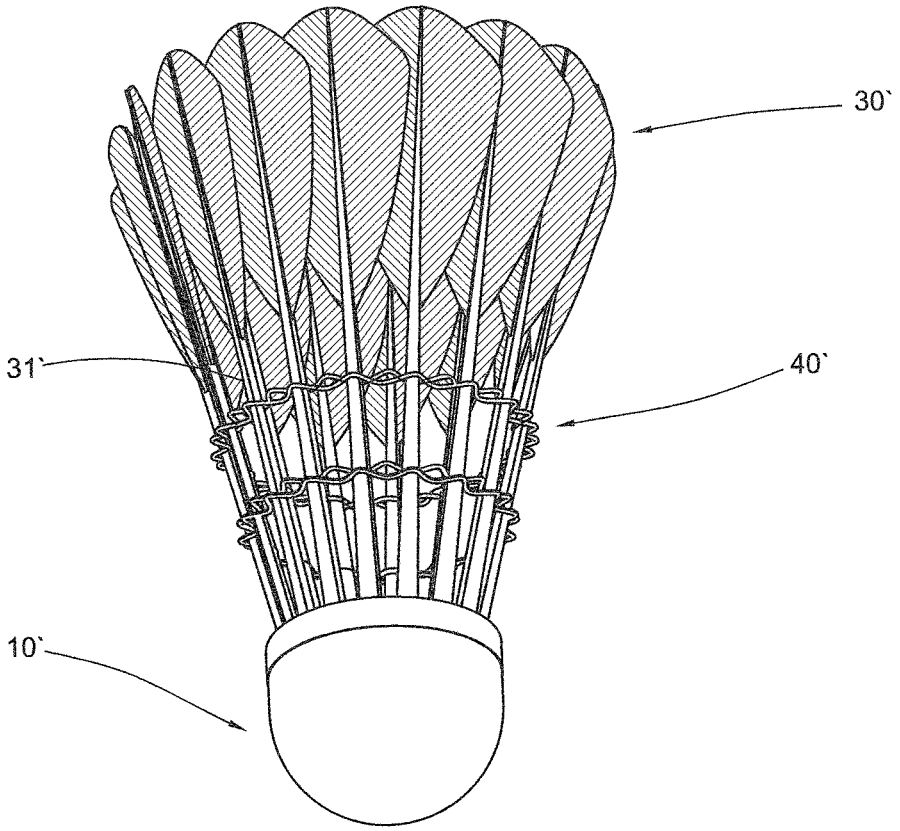
FIG. 1 PRIOR ART
FIG. 1 is a perspective view of a conventional shuttlecock according to a prior art.
Figure 2:
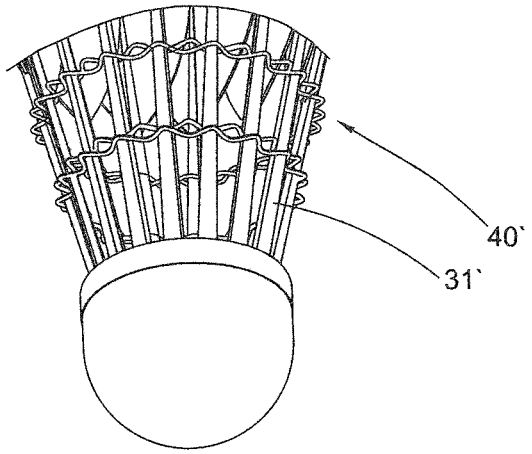
FIG. 2 PRIOR ART
FIG. 2 is a schematic view illustrating the shaft portions of the feathers of a conventional shuttlecock being connected in series using connecting strings.
Figure 3:
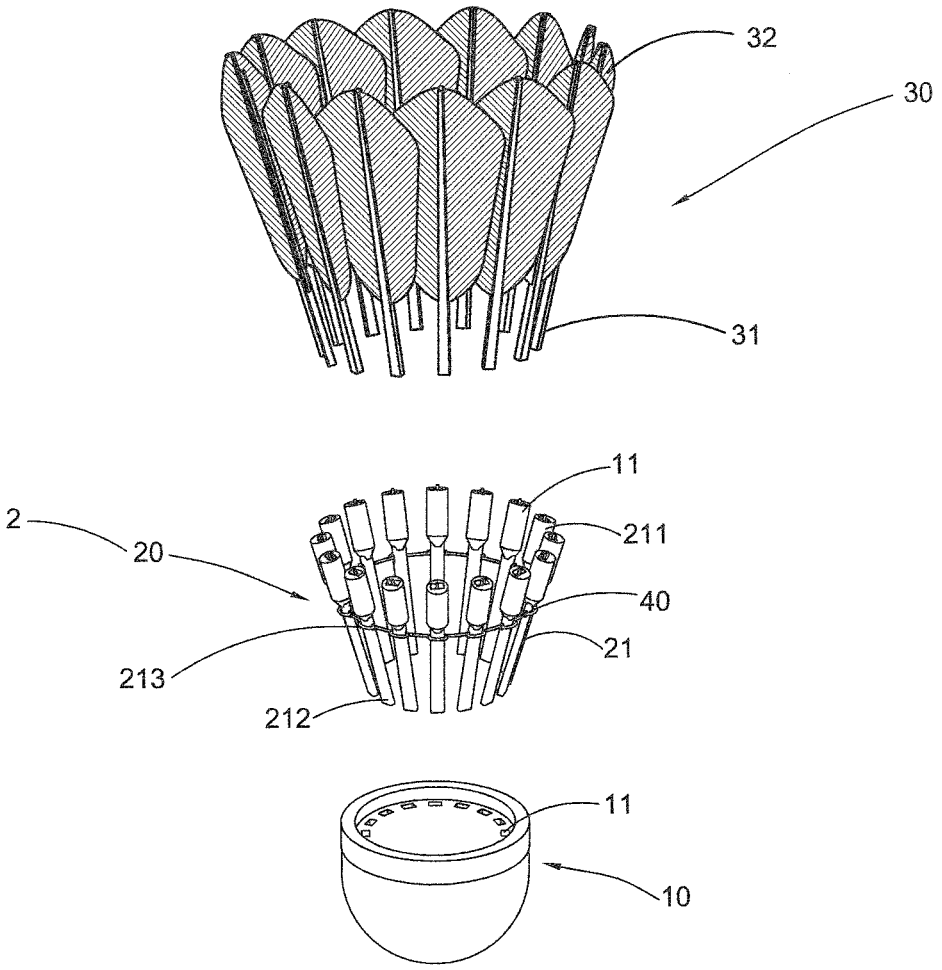
FIG. 3 is an exploded view of a shuttlecock according to a first preferred embodiment of the present invention.

Referring to FIGS. 3 and 4 of the drawings, a shuttlecock according to a first preferred embodiment of the present invention is illustrated. As shown in FIG. 3 of the drawings, the shuttlecock comprises a shuttlecock head 10, a set of feather units 30, and a connecting arrangement 2 for connecting with the shuttlecock head 10 and the feather units 30 to form a one-piece structure.

Referring to FIG. 3 of the drawings, the connecting arrangement 2 further comprises a feather planting arrangement 20 for connecting with the shuttlecock head 10 and the feather units 30 to form an integral structure. The feather planting arrangement 20 further comprises a set of feather planting members 21 of the same number as the number of the feather units, each feather planting member 21 is coupled with a feather unit 30 and connect with the shuttlecock head 10. For example, when the number of the feather units of a shuttlecock is generally sixteen, correspondingly, the number of the planting members 21 is also sixteen. Of course, the number of the planting members 21 can be increased or decreased in response to the increasing or decreasing of the number of the feather units in practical use. Each feather planting member 21 comprises a feather planting end portion 211 and an insertion end portion 212. The feather planting end portion 211 is arranged for planting the feather unit 30 while the insertion end portion is arranged for inserting in the shuttlecock head 10.

As shown in FIG. 3 of the drawings, the shuttlecock 10, which is constructed to be crown-shaped and is made of wooden or plastic material, is provided with a set of insertion grooves 11 of the same number as the number of the feather planting members for the feather planting members 21 to be inserted therein.

Referring to FIG. 3 of the drawings, each feather unit 30 comprises a shaft member 31 and a feather member 32. A length of the feather member 32 is the same length as the length of the feather portion of a conventional shuttlecock. A length of the shaft member 31 is 15-25% of a total length of the feather unit, so that the shaft member 32 is shorter than the shaft portion of the conventional shuttlecock. Therefore, the lower end of the shaft member 31 of the feather unit 30 is planted at the feather planting end portion 211 of the feather planting member 21 to form a semi-artificial feather similar of the feather of a conventional shuttlecock. In other words, the feather planting member 21 replaces the lower section of the shaft portion of the conventional shuttlecock, so that the feather used for manufacturing the shuttlecock of the present invention can be tailored to provide two or more feather units. In addition, some feathers cannot meet the requirement of the conventional shuttlecocks, for example, the shaft portion having a relatively small length, a large curvature, or a small thickness, also can be used in the present invention for planting at the feather planting member 21 to provide a semi-artificial feather, so that the utilization rate of the natural feathers can be increased. Manufacturing a conventional shuttlecock may require using feathers of two gooses or a duck, but manufacturing the shuttlecock of the present invention only need to use feathers of one goose or half duck. It is worth mentioning that the feather units 30 also can be artificial feathers.

Since the feather planting members 21 can be manufactured though a molding and pressing process, good consistence of the feather planting members 21 is ensured. In other words, all of the feather planting members 21 of a shuttlecock can be provided with same thickness, curvature, and roughness, so as to overcome the disadvantage of low consistence of the shaft portions of the feathers of the conventional shuttlecocks. The introduction of the feather planting members 21 reduces the requirement for the natural feathers, particularly reduces the requirement for the shaft members of the feathers, so that the length of the feather used in the present invention does not have to be as long as the length of the feather of the conventional shuttlecock. Therefore, more goose feathers or duck feathers can be used for manufacturing shuttlecocks, and one piece of feather may be tailored to provide two or more feather units 30, so that the utilization rate of the feather material is significantly increased.

FIG. 4 is a partial enlarged view of the feather planting member 21 of the present invention. As shown in FIG. 4 of the drawings, each feather planting end portion 211 further has a feather planting groove 2111 for insertion of the shaft member 31. Preferably, the feather planting groove 2111 is constructed to be rectangular-shaped, a width of the feather planting groove 2111 is slightly smaller than a diameter of the shaft member 31. Therefore, when each shaft member 31 of the feather is inserted in the corresponding feather planting groove 2111, the inner surface around the feather planting groove 2111 applies pressure to the shaft member 31, so that the shaft member 31 of the feather unit can be firmly secured in the feather planting groove 2111. It is worth mentioning that the feather planting groove 2111 can be shaped to match with the shape of the shaft member 31 of the feather unit. It is also worth mentioning that in order to firmly plant the shaft member 31 in the feather planting groove 2111, glues are introduced to bond the binding position between the shaft member 31 and the feather planting groove 2111.

Figure 4A:
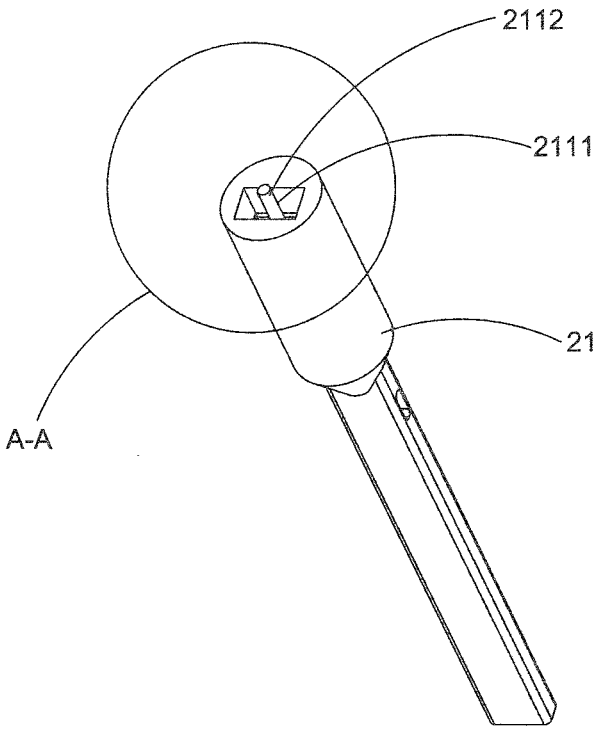
FIG. 4A is a partial enlarged view of FIG. 3 illustrating the partial structure of the feather planting member.
Figure 4B:
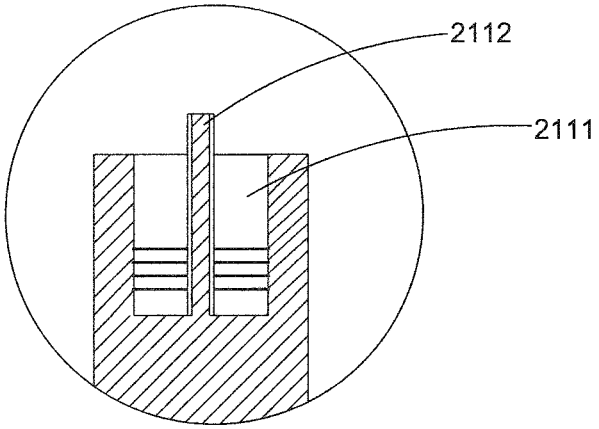
FIG. 4B is a partial sectional view of line A-A of FIG. 4A.

Referring to FIGS. 4A and 4B of the drawings, the feather planting end portion 211 further comprises an insertion core 2112 which is extended in the feather planting groove 2111. When the shaft member 31 of the feather unit 30 is inserted into the feather planting groove 2111, the insertion core 2112 is simultaneously inserted into the center of the shaft member 31, so that the insertion core 2112 not only enables the firm engagement between the shaft member 31 and the feather planting end portion 211 of the feather planting member 21, but also enhances the roughness of the shaft member 31, so as to prevent the shaft member 31 from fracturing.

Figure 6:
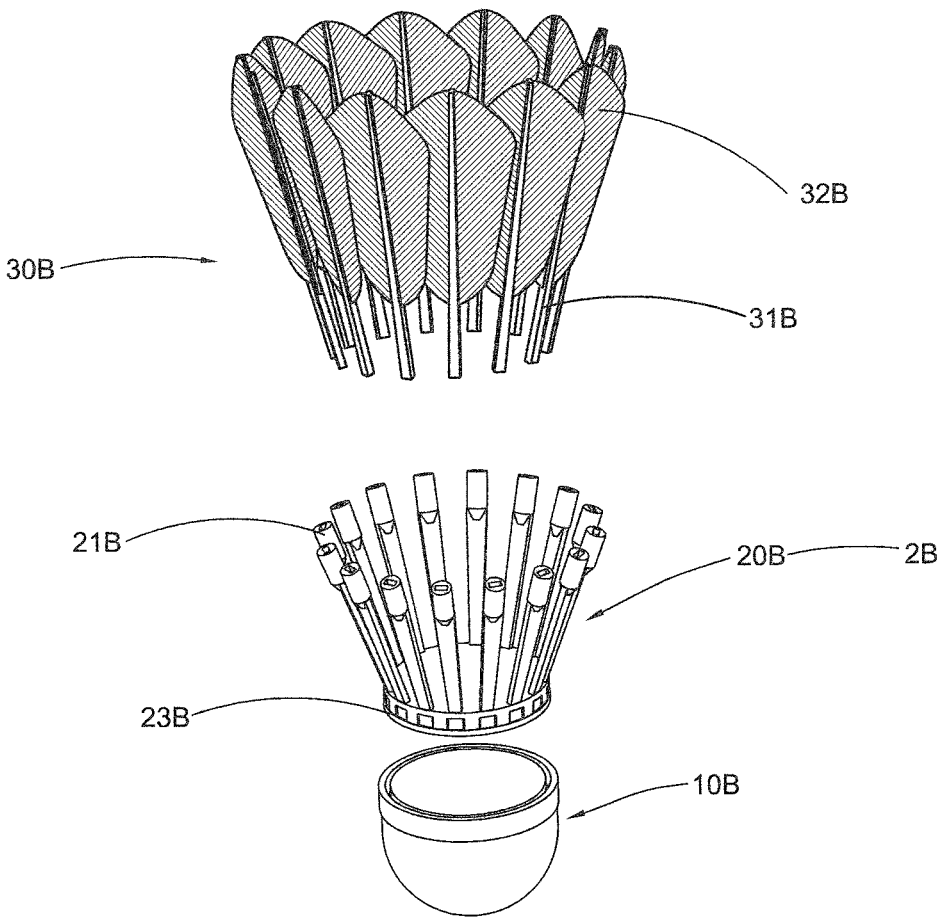
FIG. 6 is an exploded view of a shuttlecock according to a third preferred embodiment of the present invention.

It is worth mentioning that the connecting arrangement 2 further comprises a connecting string 40 for connecting the feather planting members 21 in series to for a hollow taper body. As shown in FIG. 6 of the drawings, each feather planting member 21 comprises a series connecting portion 213 for connecting all of the feather planting members 21 of the shuttlecock with the connecting string 40, so that when the shuttlecock head of the shuttlecock is under a strike, all of the feather planting members 21 of the shuttlecock can integrally and evenly distribute the impact force, so that the whole shuttlecock flies stably.

It is worth mentioning that each series connection portion 213 can be embodied as a groove in the feather planting member 21, or a penetrating hole in the feather planting member 21. The positions of the series connecting portion 213 can be provided at a same level of the feather planting members 21, so as to not only ensure that the connecting string 40 can be provided at a same position at the feather planting members 21, but also firmly connect the feather planting members 21 with the connecting string 40 without use of glues, so that the shuttlecock will not be overweight, and when one of the feather units is broken, it is easy to replace with a new feather unit for repairing.

It is worth mentioning that a same angle, such as 10-15°, is defined between center lines of two adjacent feather planting members 21. Each feather planting member 21 define a same tapering angle, such as 16-20°, with respect to the bottom plane of the feather plating arrangement.

The manufacturing method of the shuttlecock of the present invention comprises the following steps.

(a) Provide a set of feather units 30, the number of the feather units 30 is sixteen.

(b) Plant the set of feather units 30 at the connecting arrangement 2. The connecting arrangement 2 comprises a feather planting arrangement 20 comprising sixteen feather planting members 21, each shaft member 31 of the feather unit 30 is planted at the corresponding feather planting member 21, so as to form a semi-artificial feather unit which has a same length as the length of the natural feather of the conventional shuttlecock, and comprises a feather member of the same shape and size as the shape and sized of the feather portion of the conventional shuttlecock.

(c) Connect the connecting arrangement with a shuttlecock head. The shuttlecock head 10 is provided with a set of insertion grooves 11 of the same number as the number of the feather planting members 21, and the opening of each insertion groove 11 is shaped and sized to couple with the shape and size of the corresponding feather planting member 21.

In the above method, the order of the steps (b) and (c) can be reversed. In other words, we can plant the feather units 30 at the connecting arrangement 21 first, and then couple the connecting arrangement 2 with the shuttlecock head 10. Alternatively, we can couple the connecting arrangement 2 with the shuttlecock head 10 first, and then plant the feather units 30 at the connecting arrangement 21.

It is worth mentioning that the method for manufacturing the shuttlecock of the present invention further comprises a step (d): connecting the feather planting members 21 in series via a connecting string 40 so as to form a hollow taper body, so that the good flying stability of the shuttlecock is ensured.

It is worth mentioning that in order to firmly couple the connecting arrangement 2 with the shuttlecock head 10, the method for manufacturing the shuttlecock of the present invention further comprises a step (e): applying glues at the binding positions between the feather planting members 21 and the insertion grooves 11.

Embodiment 2

Figure 5:
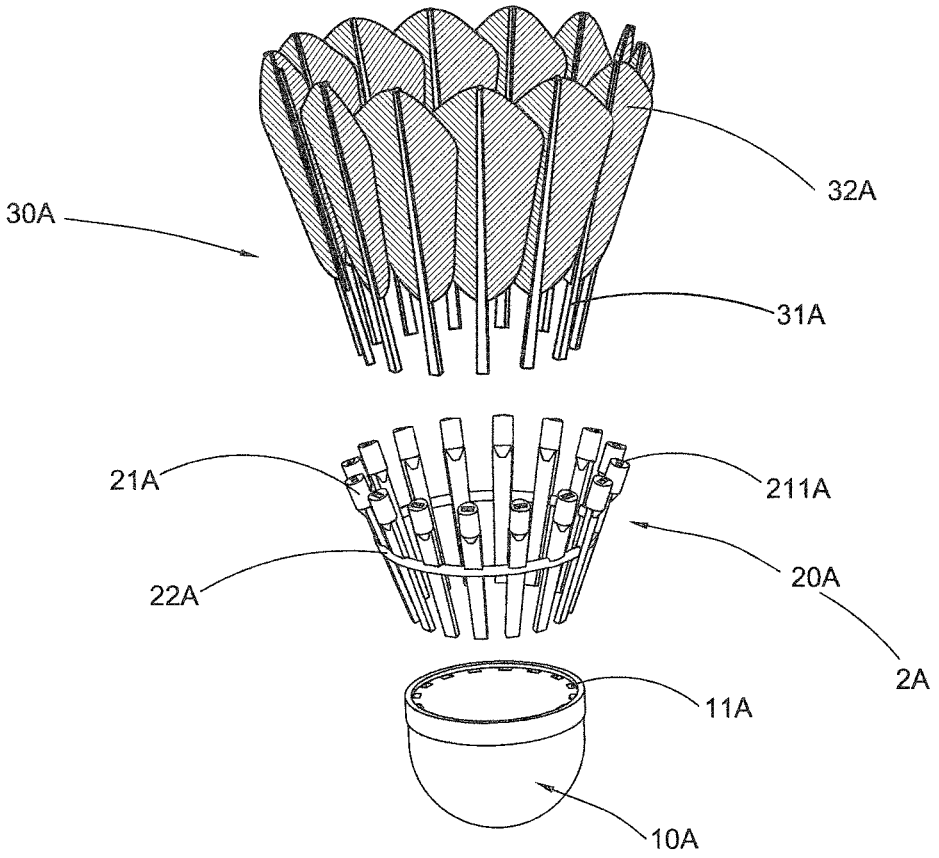
FIG. 5 is an exploded view of a shuttlecock according to a second preferred embodiment of the present invention.

FIG. 5 is a perspective view of a shuttlecock according to a second preferred embodiment of the present invention, wherein the shuttlecock comprises a shuttlecock head 10A, a set of feather units 30A, and a connecting arrangement 2A for connecting with the shuttlecock head 10A and the feather units 30A to form an integral shuttlecock. The feather units of the shuttlecock of this preferred embodiment is the same as the feather units of the above first preferred embodiment. The connecting arrangement 2A is provided with some modifications.

Referring to FIG. 5 of the drawings, the connecting arrangement 2A comprises a feather planting arrangement 20A for connecting with the shuttlecock head 10A and the feather units 30A to form an integral structure. The feather planting arrangement 20A comprises a set of feather planting members 21A of the same number as the number of the feather units 30A, and a connecting rib 22A for connecting the feather planting members 21A in series. It is worth mentioning that the number of the connecting rib 22A can be increased or decreased depending on the practical use, the shape of the connecting rib 22A also can be changed. In other words, the connecting rib 22A is introduced to replace the connecting string 40 of the above first preferred embodiment. The feather planting members 21A and the connecting rib 22A can be previously prepared in a manufacturing mold, and then undergo a mold injection process to form a one-piece structure. Thus, the distance between the two adjacent feather planting members 21A can be the same, the insertion grooves 11 provided in the shuttlecock head 10 enable the angle between the two adjacent feather planting members 21A to be the same, so that the taper angle of the shuttlecock is under control, and thus good flying stability of the shuttlecock is ensured.

It is worth mentioning that the feather planting members 21A and the connecting rib 22A are molded to form an integral structure. In other words, the connecting rib 22A is introduced to replace the connecting string 40 of the above first preferred embodiment, so that the manufacturing method omits a step which is to wind and connect the feather planting members 21A via the connecting string 40.

It is still worth mentioning that since the feather planting members 21A and the connecting rib 22A are molded to form an integral structure, the manufacturing mold can be configured to ensure a same angle between the two adjacent feather planting members 21A, so that the connecting rib 22A can be connected at any position at each feather planting member 21A, the length of the connecting rib 22A between two adjacent feather planting members 21A can be varied, so as to enhance the aesthetic appearance of the shuttlecock without influencing the flying stability of the shuttlecock.

It is worth mentioning that since the feather planting members 21A and the connecting rib 22A are molded to form an integral structure, all feather planting members 21A define a same angle with respect to the center axial line of the shuttlecock, so that a good taper angle of the shuttlecock is ensured, and thus the shuttlecock can fly stably.

It is worth mentioning that the shape of the feather planting groove 2111A of each feather planting member 21A can be varied depending on the shape of the shaft member 31A of the corresponding feather unit 30A. Although the shapes of the shaft members 31A of the natural feathers vary largely, the shape of the shaft member 31A of each natural feather is generally rectangular-shaped. Therefore, each feather planting groove 2111A is configurated to have a substantially rectangular shape via the manufacturing mold, and the diameter of the opening there of is slightly smaller than the diameter of the shaft member of the feather unit. When each shaft member 31A is inserted into the corresponding feather planting groove 2111A, the inner surface around the feather planting groove 2111A and the shaft member 31A contact and press with each other, so that the shaft member 31A is secured at the feather planting end portion 211A of the feather planting member 3A, thus the shaft member 31A is not easy to slip off.

It is worth mentioning that each feather planting groove 2111A of the feather planting member 21A defines an eccentric angle with respect to the center of the feather planting arrangement 20A, and the values of any two eccentric angles of all the eccentric angles are the same, so that when each feather unit 30A is planted in corresponding feather planting groove 2111A, an eccentric angle is formed, and the values of the any two eccentric angles are the same, while the distance of the gap between feather members 32A of two adjacent feather units 30A is the same, so that the shuttlecock can spin during flying, so as to enhance the flying stability.

It is worth mentioning that since the connecting rib 22A is introduced to replace the connecting string of conventional shuttlecock, there is no need for applying glues to the binding positions between the connecting string and the shaft members of the feather units. In addition, since the feather planting members 21A and the connecting rib 22A are molded to form an integral structure, the weight of the whole feather planting arrangement is under control, and thus use of the feather planting arrangement of the present invention to produce the shuttlecock can effectively avoid the excess use of glues which results in an overweight of the shuttlecock.

The method for manufacturing the shuttlecock of the present invention comprises the following steps.

(a) Provide a set of feather units 30A, the number of the feather units 30A is sixteen.

(b) Plant the set of feather units 30A at the connecting arrangement 2A. The connecting arrangement 2A comprises a feather planting arrangement 20A comprising sixteen feather planting members 21A and a connecting rib 22A for connecting the feather planting members 21A in series, each shaft member 31A of the feather unit 30A is planted at the corresponding feather planting member 21A, so as to form a semi-artificial feather unit which has a same length as the length of the natural feather of the conventional shuttlecock, and comprises a feather member of the same shape and size as the shape and sized of the feather portion of the conventional shuttlecock.

(c) Connect the connecting arrangement with a shuttlecock head. The shuttlecock head 10A is provided with a set of insertion grooves 11A of the same number as the number of the feather planting members 21A, and the opening of each insertion groove 11A is shaped and sized to couple with the shape and size of the corresponding feather planing member 21A.

In the above method, the order of the steps (b) and (c) can be reversed. In other words, we can plant the feather units 30A at the connecting arrangement 21A first, and then couple the connecting arrangement 2A with the shuttlecock head 10A. Alternatively, we can couple the connecting arrangement 2A with the shuttlecock head 10A first, and then plant the feather units 30A at the connecting arrangement 21A.

Embodiment 3

Figure 7:
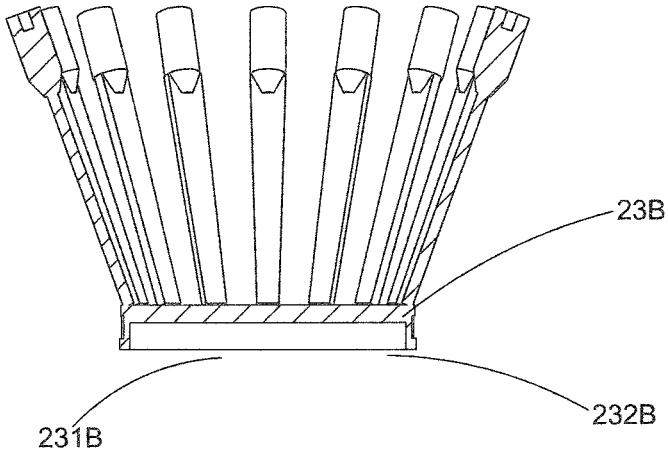
FIG. 7 is a longitudinal sectional view of the feather planting arrangement of FIG. 6.
Figure 8:
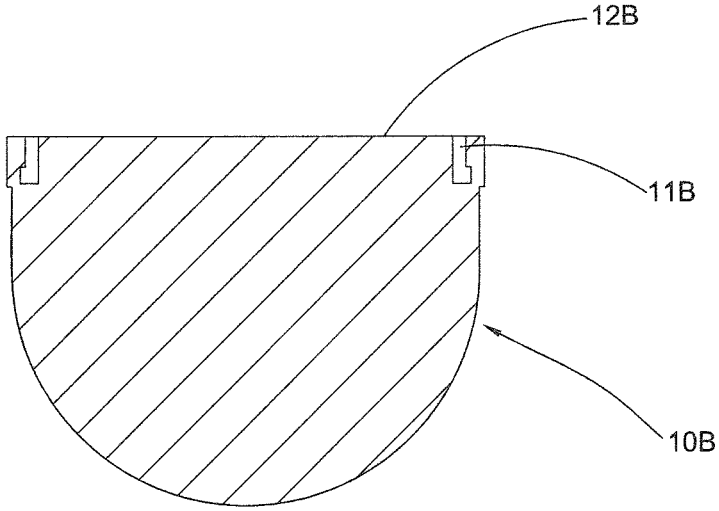
FIG. 8 is a longitudinal sectional view of the shuttlecock head of FIG. 6.

Referring to FIGS. 6 to 8 of the drawings, a shuttlecock according to a third preferred embodiment of the present invention is illustrated, wherein the shuttlecock comprises a shuttlecock head 10B, a set of feather units 30B, and a connecting arrangement 2B for connecting with the shuttlecock head 10B and the feather units 30B to form an integral shuttlecock. The shuttlecock of this preferred embodiment is similar to the shuttlecock of the above first and second preferred embodiment, except that the connecting arrangement 2B and the shuttlecock head 10B are provided with some modifications.

Referring to FIG. 6 of the drawings, the connecting arrangement 2B comprises a feather planting arrangement 20B for connecting with the shuttlecock head 10B and the feather units 30B to form an integral structure. The feather planting arrangement 20B comprises a connecting element 23B, and a set of feather planting members 21B of the same number as the number of the feather units 30B. The set of feather planting members 21B is radially extended from the connecting element 23B to form a taper body, and the connecting element 23B is integrally formed with the feather planting members 31B to form a one-piece structure.

FIG. 7 is a longitudinal sectional view of the feather planting arrangement 20B, as shown in FIG. 7 of the drawings, the connecting element 23B of the feather planting arrangement 20B comprises an insertion wall 231B and an insertion cavity 232B defined by the insertion wall 231B, the insertion wall 231B of the connecting element 23B is inserted into the shuttlecock head 10B so as to connect the connecting element 23B with shuttlecock head 10B.

FIG. 8 is a longitudinal sectional view of the shuttlecock head 10B, as shown in FIG. 8 of the drawings, the shuttlecock head has an insertion groove 11B and an insertion pin 12B provided at a center of the insertion groove 11B. When the feather planting arrangement 20B is connected with the shuttlecock head 10B, the insertion wall 231B of the connecting element 23B is inserted into the shuttlecock head 10B, the insertion groove 11B is shaped and sized to couple with the shape and size of the insertion wall 231B, the insertion cavity 232B is positioned around the insertion pin 12B at the center of the insertion groove 11B. In other words, the shuttlecock head 10B is coupled with the connecting element 23B in an insertion and retention coupling manner, the insertion pin 12B of the shuttlecock head 10B is inserted in the insertion cavity 232B, simultaneously, the insertion wall 231B of the connecting element 23B is inserted into the insertion groove 11B, so that the issue of the hollow core of the shuttlecock head 10B is solved, and when the shuttlecock is under a strike by the shuttlecock racket, the shuttlecock head 10B will not easy to fracture.

It is worth mentioning that the insertion wall 231B of the connecting element 23B may have a regular shape such as a cylinder shape and a triangular prism shape. Preferably, the outer appearance of the insertion wall 231B is embodied as cylinder-shaped. Correspondingly, the insertion pin 12B of the shuttlecock head 10B is also constructed to be cylinder-shaped. The insertion groove 11B is ring-shaped. The diameter of the insertion cavity 232B is slightly larger than the diameter of the insertion pin 12B, while the thickness of the insertion wall 231B is equal or slightly smaller than the width of the insertion groove 12B. When the insertion wall 231B is inserted into the insertion groove 11B, the connecting element 23B is capable of firmly coupling with the shuttlecock head 10B, so that the feather planting arrangement is able to firmly secured with the shuttlecock head.

The method for manufacturing the shuttlecock of the present invention comprises the following steps.

(a) Provide a set of feather units 30B, the number of the feather units 30B is sixteen.

(b) Plant the set of feather units 30B at a connecting arrangement 2B. The connecting arrangement 2B comprises a feather planting arrangement 20B comprising a connecting element 23B and a set of feather planting members 21B of a same number as the number of feather units 30B, wherein the feather planting members 21B are radially extended from the connecting element to form a taper body, and the connection element 23B and the feather planting members 21B are manufactured in a mold injection process to form a one-piece structure, each shaft member 31B of the feather unit 30B is planted at the corresponding feather planting member 21B, so as to form a semi-artificial feather unit which has a same length as the length of the natural feather of the conventional shuttlecock, and comprises a feather member of the same shape and size as the shape and sized of the feather portion of the conventional shuttlecock.

(c) Connect the connecting arrangement 2B with a shuttlecock head 10B. The shuttlecock head 10B is provided with an insertion groove 11B and an insertion pin 12B at the center of insertion groove 11B, and the opening of each insertion groove 11B is shaped and sized to couple with the shape and size of the corresponding feather planing member 21B. The connecting element 23B is inserted in the insertion groove 11B of the shuttlecock head 10B and is simultaneously housing around the insertion pin 12B.

In the above method, the order of the steps (b) and (c) can be reversed. In other words, we can plant the feather units 30B at the connecting arrangement 21B first, and then couple the connecting arrangement 2B with the shuttlecock head 10B. Alternatively, we can couple the connecting arrangement 2B with the shuttlecock head 10B first, and then plant the feather units 30B at the connecting arrangement 21B.

It is worth mentioning that in order for firmly coupling the connecting arrangement 2B and the shuttlecock head 10B, the method for manufacturing the shuttlecock further comprises a step (f): applying glues to the binding positions between the connecting arrangement 2B and the shuttlecock head. Preferably, glues are applied on the connecting element 23B and the insertion pin 12B.

Embodiment 4

Referring to FIGS. 9 to 17 of the drawings, a shuttlecock according to a fourth preferred embodiment of the present invention is illustrated, wherein several alternative modes of the connecting arrangement of the shuttlecock are illustrated. The connecting arrangement comprises a feather planting arrangement which comprises a set of feather planting members and a set of feather planting tubes. In other words, a portion of each feather planing member of the first preferred embodiment is embodied as a feather planting tube of this preferred embodiment. The feather planting groove 2111 is formed in the feather planting tube of this preferred embodiment. In other words, each feather planting tube of this preferred embodiment is used for the insertion of the shaft member of the feather unit. It is worth mentioning that the center line of the feather planting tube is the same center line of the feather planting member. In other words, each feather planting tube is coaxial with the corresponding feather planting member.

Figure 9:
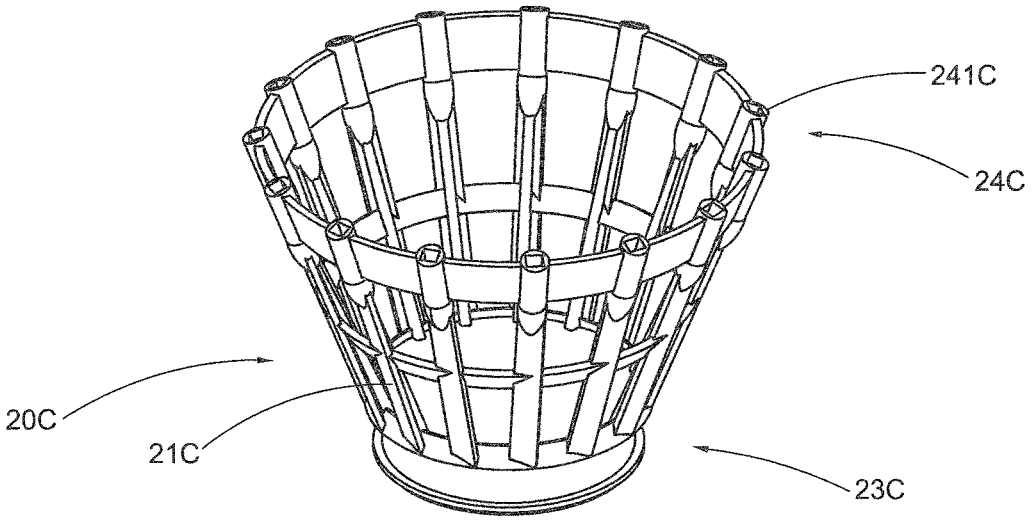
FIGS. 9 to 17 are schematic views illustrating a shuttlecock according to a fourth preferred embodiment of the present invention.

Referring to FIG. 9 of the drawings, the feather planting arrangement 20C comprises a set of feather planting members 21C and a set of feather planting tubes 24C which are respectively provided at end portions of the corresponding feather planting members 21C. According to this preferred embodiment, the number of the feather planting members 21C is the same as the number of the feather planting tubes 24C and each feather planting member 21C is linearly arranged with the corresponding feather planting tube 24C.

Figure 10:
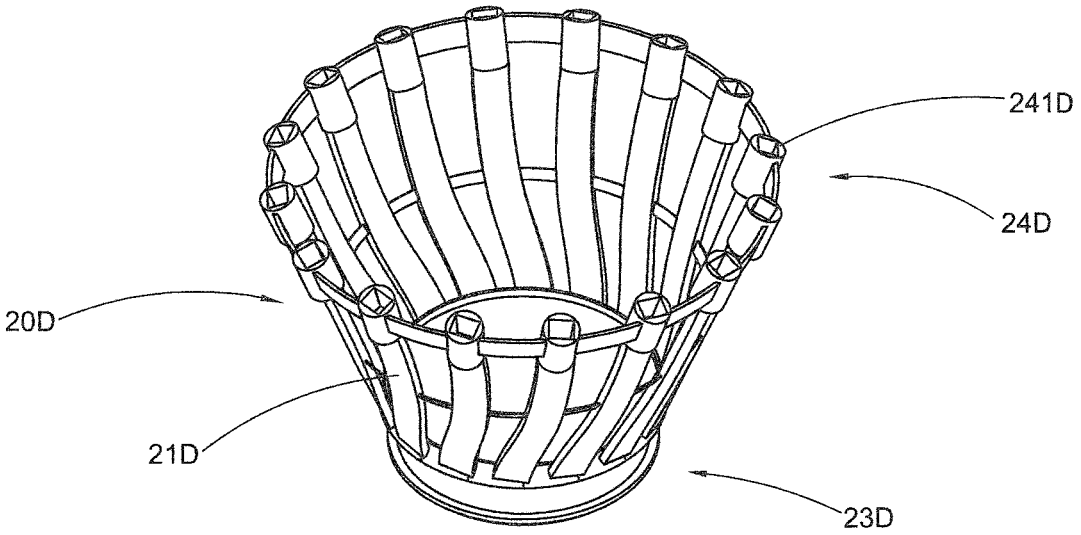

Referring to FIG. 10 of the drawings, the feather planting arrangement 20D comprises a set of feather planting members 21D and a set of feather planting tubes 24D which are respectively provided at end portions of the corresponding feather planting members 21D. Each feather planting tube 24D is provided with a feather planting groove 241D for the insertion of the shaft member of the feather unit. According to this preferred embodiment, the number of the feather planting members 21C is the same as the number of the feather planting tubes 24C, and each feather planting member 21C is arranged with the corresponding feather planting tube 24C in a spirally extending manner.

Figure 11:
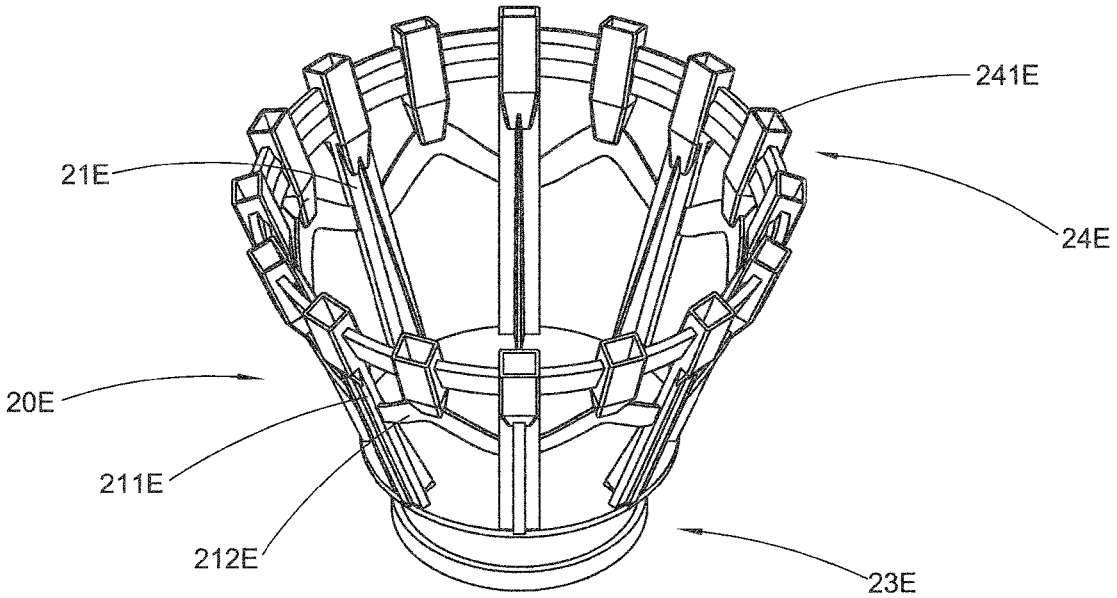

Referring to FIG. 11 of the drawings, the feather planting arrangement 20E comprises a set of feather planting members 21E and a set of feather planting tubes 24E which are respectively provided at end portions of the corresponding feather planting members 21E. Each feather planting tube 24E is provided with a feather planting groove 241E for the insertion of the shaft member of the feather unit. According to this preferred embodiment, each feather planting member 21E is constructed to be Y-shaped, so that each feather planting member 21E is provided with a number of the feather planting tubes 24E. More specifically, each feather planting member 21E comprises a main portion 211E and two branch portions 212E extended from the main portions 211E respectively, the branch portions 211E at the adjacent feather planting members are connected to each other. Each feather planting tube 24E is provided at an end portion of the main portion 211E or provided at an end portion of one of the two branch portions 212E.

Figure 12:
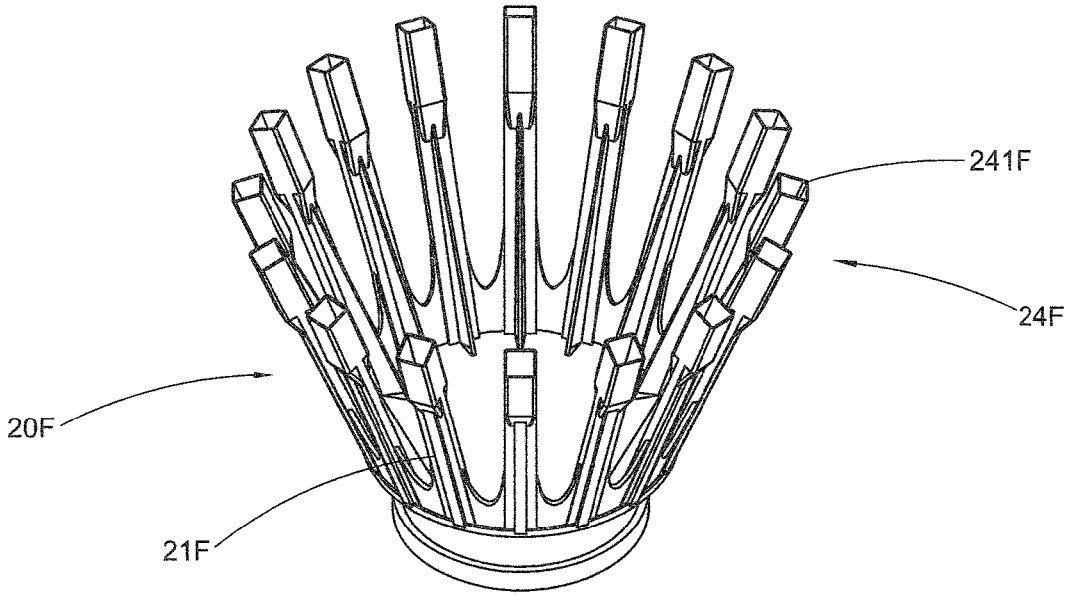

Referring to FIG. 12 of the drawings, the feather planting arrangement 20F comprises a set of feather planting members 21F and a set of feather planting tubes 24F which are respectively provided at end portions of the corresponding feather planting members 21F. Each feather planting tube 24F is provided with a feather planting groove 241F for the insertion of the shaft member of the feather unit. According to this preferred embodiment, the number of the feather planting members 21F is the same as the number of the feather planting tubes 24F and each feather planting member 21F is linearly arranged with the corresponding feather planting tube 24F. It is worth mentioning that the connecting arrangement 2F is not provided with connecting string 40 of the first preferred embodiment, nor the connecting rib 22A of the second preferred embodiment.

Figure 13:
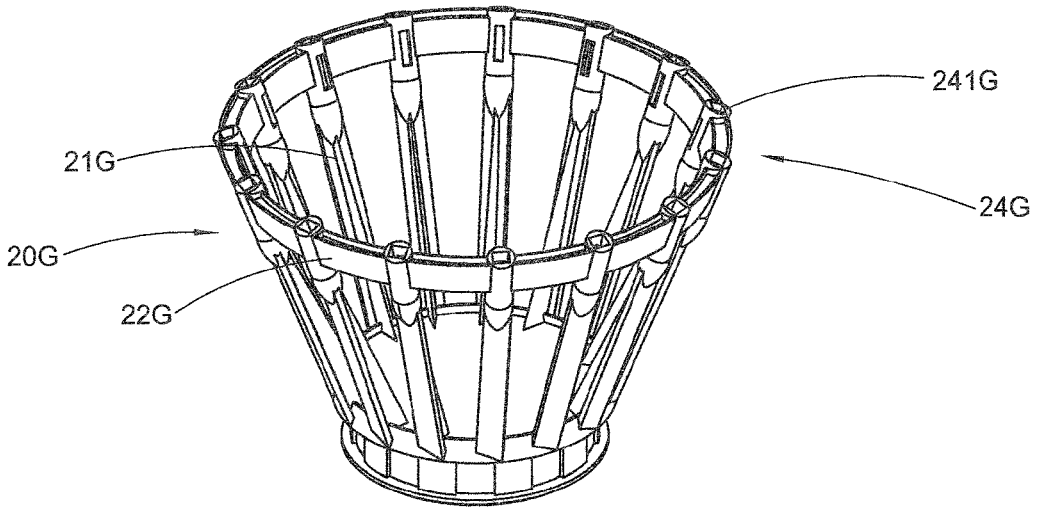

Referring to FIG. 13 of the drawings, the structure of the feather planting arrangement 20G is similar to the structure of the feather planting arrangement 20F shown in FIG. 12 of the drawings. The difference is that the feather planting arrangement 20G is further provided with a connecting rib 22G for connecting the set of feather planting members 21G or connecting the set of feather planting tubes 24G. According to this preferred embodiment, the connecting rib 22G connects the set of feather planting tubes 24G.

Figure 14:
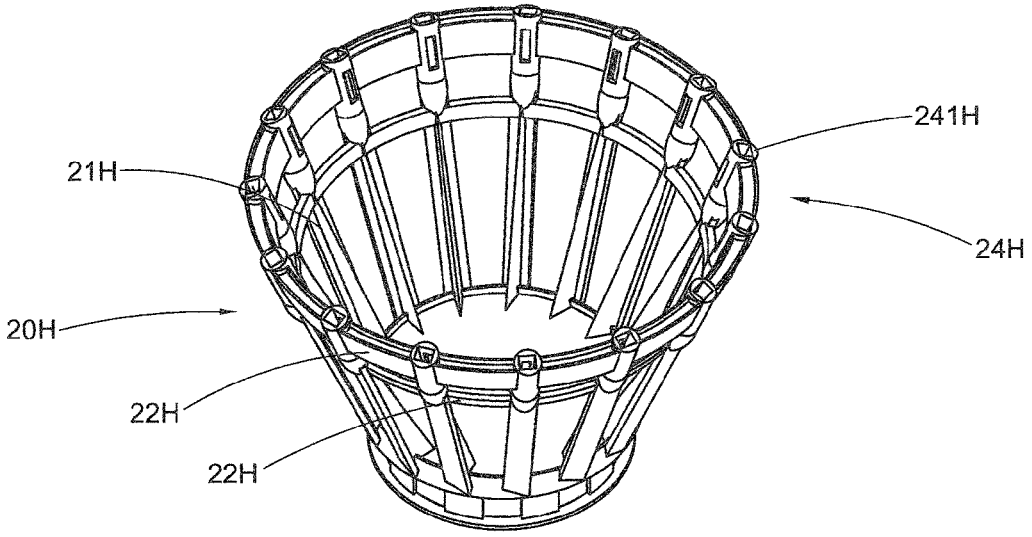

Referring to FIG. 14 of the drawings, the structure of the feather planting arrangement 20H is similar to the structure of the feather planting arrangement 20F shown in FIG. 12 of the drawings. The difference is that the feather planting arrangement 20H is further provided with two connecting ribs 22H for connecting the set of feather planting members 21H and connecting the set of feather planting tubes 24H respectively.

Figure 15:
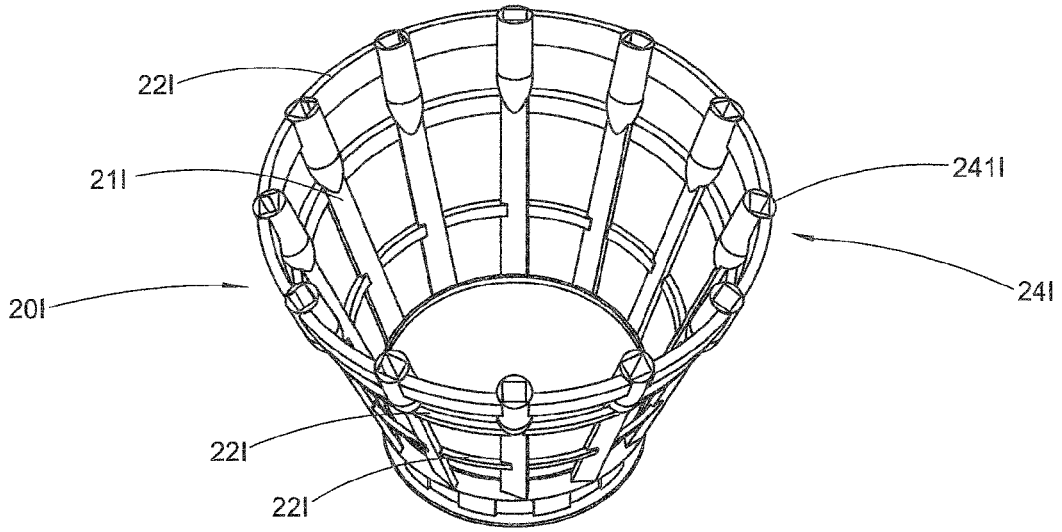

Referring to FIG. 15 of the drawings, the structure of the feather planting arrangement 20I is similar to the structure of the feather planting arrangement 20F shown in FIG. 12 of the drawings. The difference is that the feather planting arrangement 20I is further provided with three connecting ribs 22I, and two connecting ribs 22I are arranged for connecting the set of feather planting members 21I and the rest one connecting rib 22I connecting the set of feather planting tubes 24H respectively.

Figure 16:
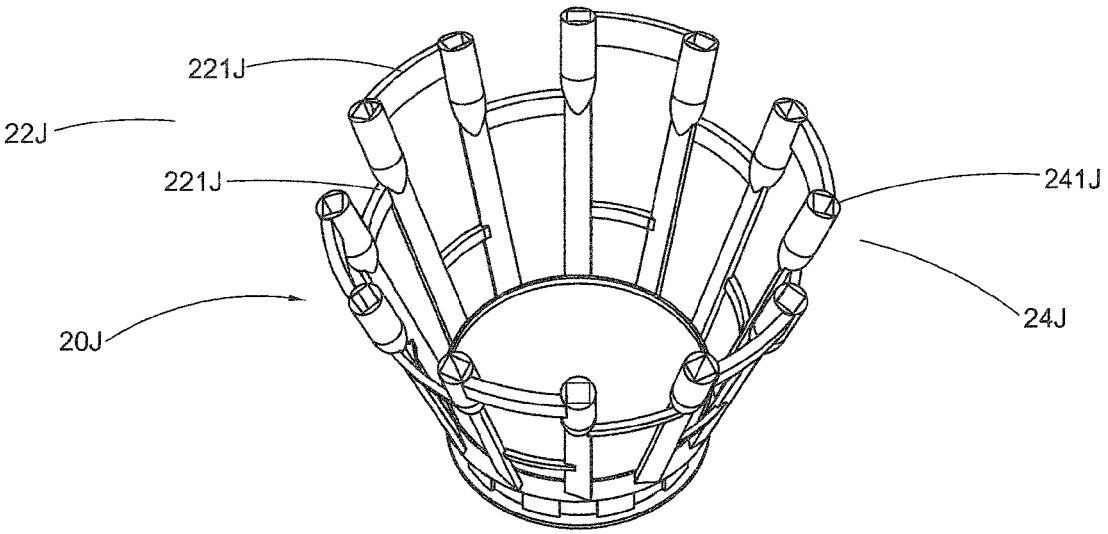

Referring to FIG. 16 of the drawings, the structure of the feather planting arrangement 20J is similar to the structure of the feather planting arrangement 20G shown in FIG. 13 of the drawings. The difference is that the connecting rib 22J of feather planting arrangement 20J is provided with a plurality of connecting rib sections 221J which are provided between the adjacent feather planting members 21J/feather planting tubes 24J in a staggered manner.

Figure 17:
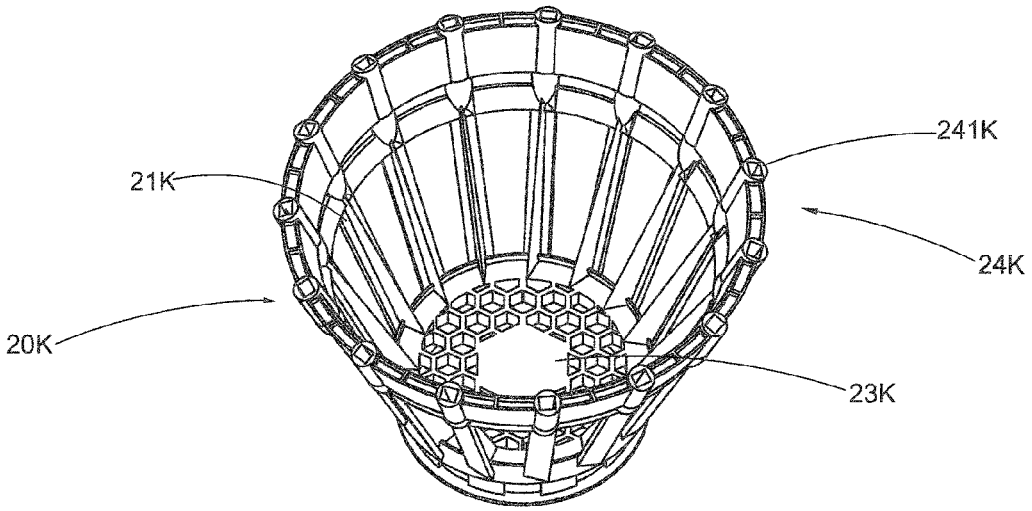

Referring to FIG. 17 of the drawings, according to an alternative mode of the preferred embodiment, the main part of the connecting element 23K is embodied to have a net like structure.

Embodiment 5

Referring to FIGS. 18 to 21 of the drawings, a number of alternative modes of the connecting arrangement of the shuttlecock of the present invention are illustrated. The connecting arrangement comprises a feather planting arrangement which comprises a set of feather planting members and a set of feather planting tubes. The feather planting arrangement of this preferred embodiment is similar to the feather planting arrangement of the fourth preferred embodiment, the difference is that the center line of each feather planting tube does not the same center line of the corresponding feather planting member. In other words, each feather planting tube is not coaxially arranged with the corresponding feather planting member.

Figure 18:
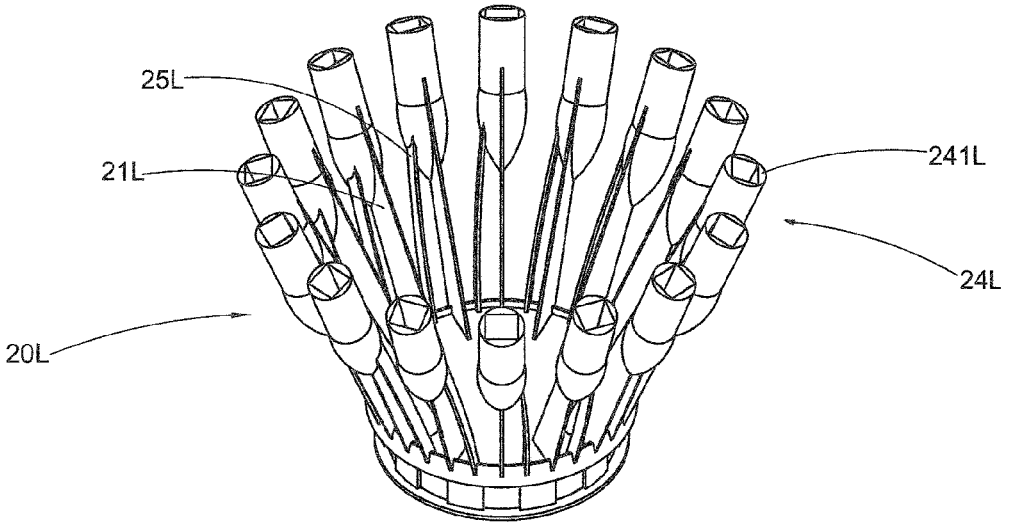
FIGS. 18 to 21 are schematic views illustrating a shuttlecock according to a fifth preferred embodiment of the present invention.

Referring to FIG. 18 of the drawings, the feather planting arrangement 20L comprises a set of feather planting members 21L and a set of feather planting tubes 24L which are respectively provided at end portions of the corresponding feather planting members 21L. Each feather planting tube 24L is provided with a feather planting groove 241L for the insertion of the shaft member of the feather unit. According to this preferred embodiment, the feather planting arrangement 20L further comprises a set of side enhancing rib 25L. In other words, each feather planting tube 24L is supported by a corresponding feather planting member 21L and a side enhancing rib 25L.

Figure 19:
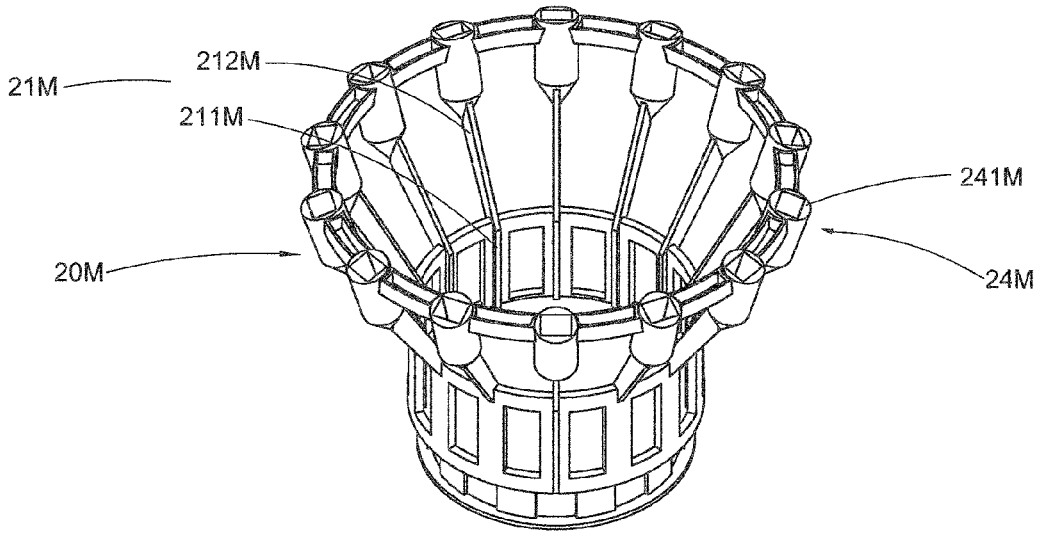

Referring to FIG. 19 of the drawings, the feather planting arrangement 20M comprises a set of feather planting members 21M and a set of feather planting tubes 24M which are respectively provided at end portions of the corresponding feather planting members 21M. Each feather planting tube 24M is provided with a feather planting groove 241M for the insertion of the shaft member of the feather unit. According to this preferred embodiment, each of the feather planting member 21M is bended into several sections to provide the supporting performance. More specifically, each of the feather planting member 21M comprises a base portion 211M and a supporting portion 212M which is inclinedly extended from the base portion 211M. Each feather planting tube 24M is provided at the corresponding supporting portion 212M.

Figure 20:
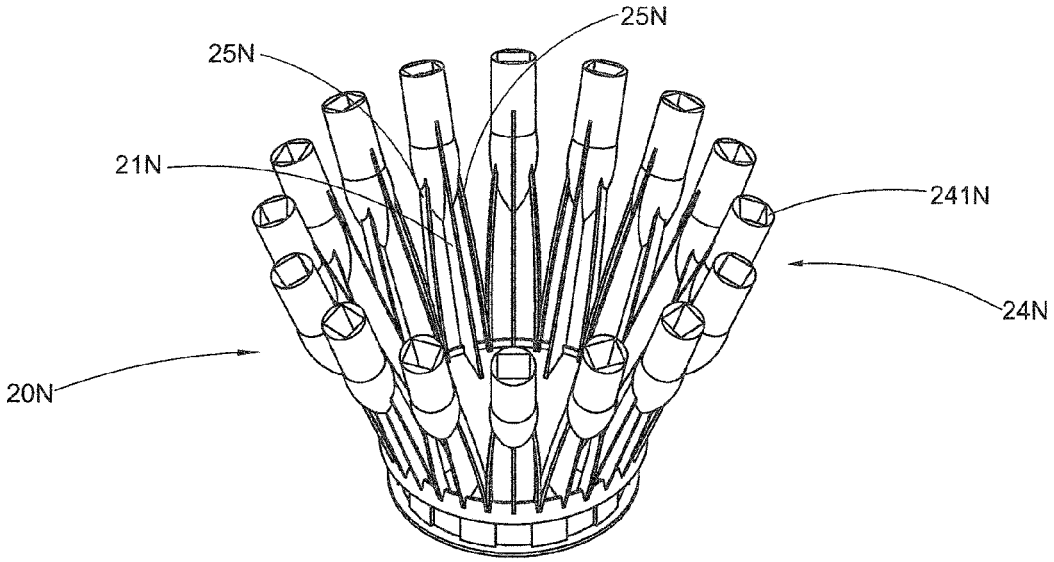

Referring to FIG. 20 of the drawings, the feather planting arrangement 20N comprises a set of feather planting members 21N and a set of feather planting tubes 24N which are respectively provided at end portions of the corresponding feather planting members 21N. Each feather planting tube 24N is provided with a feather planting groove 241N for the insertion of the shaft member of the feather unit. According to this preferred embodiment, the feather planting arrangement 20N further comprises a set of double-side enhancing ribs 25N. In other words, each feather planting tube 24M is supported by a corresponding feather planting member 21N and two enhancing ribs 25N.

Figure 21:
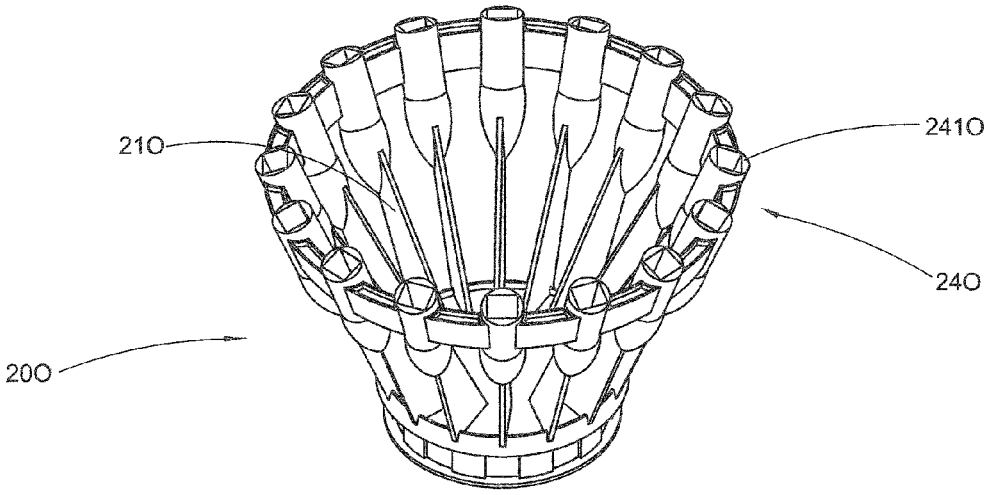

Referring to FIG. 21 of the drawings, the feather planting arrangement 20O comprises a set of feather planting members 21O and a set of feather planting tubes 24O which are respectively provided at end portions of the corresponding feather planting members 21O. Each feather planting tube 24O is provided with a feather planting groove 241O for the insertion of the shaft member of the feather unit. According to this preferred embodiment, each feather planting tube 24O is inclinedly provided at an end portion of the corresponding feather planting member 21O, so as to inclinedly support each feather planting member 21O.

Embodiment 6

Figure 22:
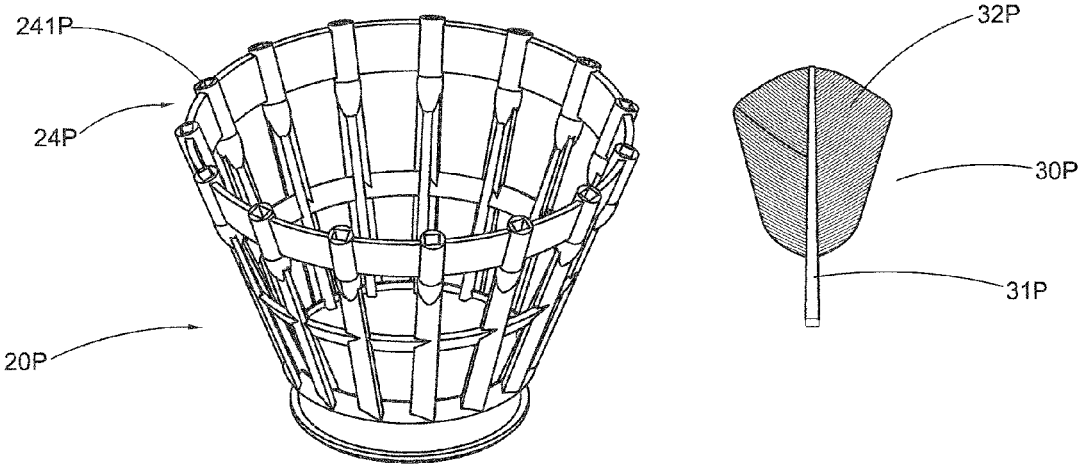
FIGS. 22 to 24 are schematic views illustrating a shuttlecock according to a sixth preferred embodiment of the present invention.
Figure 23:
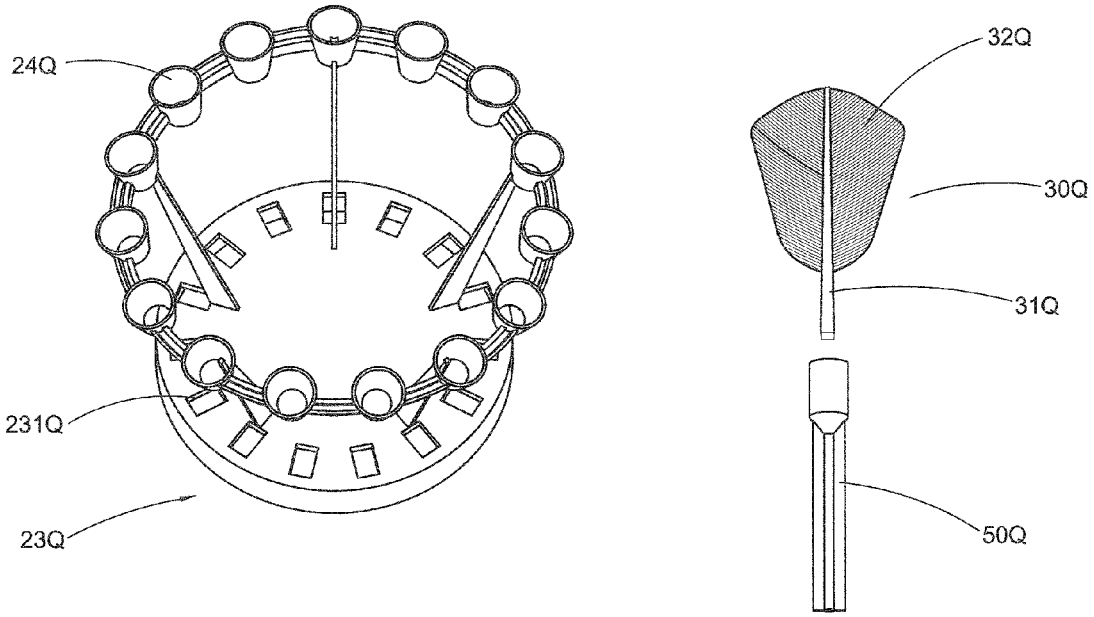
Figure 24:
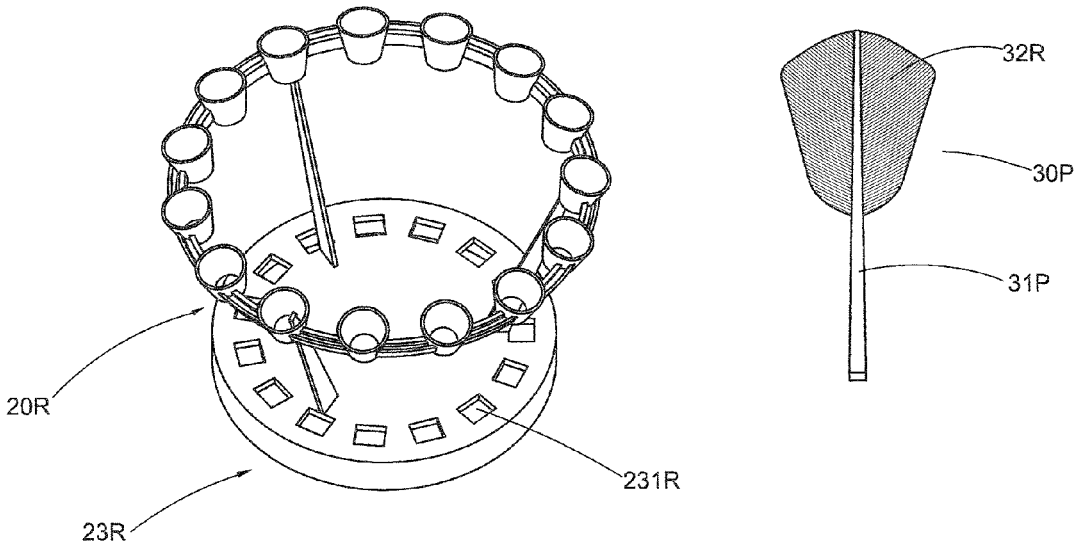

FIGS. 22 to 24 are schematic views illustrating the connection between the feather units an the feather planting arrangement of the connecting arrangement.

Referring to FIG. 22 of the drawings, an end portion of the shaft member 31P of each feather unit 30P is planted into the corresponding feather planting groove 241P of the feather planting tube 24P of the feather planting arrangement 20P. It is worth mentioning that the feather units 30P can be made of natural feathers. The feather planting members 21 are introduced to replace the shaft portions of conventional shuttlecocks, so that the prosperity of the feather members 32 of natural feathers is utilized, such as achieving a quick head reversing action through the opening and closing of the feather members after the shuttlecock is under a strike, while disadvantages resulting from the inconsistence of the thickness, curvature, the degree of arch of the natural feathers can be avoided.

Referring to FIG. 23 of the drawings, according to this alternative mode, each feather unit 30Q is installed at an artificial rod 50Q. The connecting member 23Q of the feather planting arrangement 20Q is provided with feather planting grooves 231Q, each artificial rod 50Q which is planted with the feather unit 30Q is inserted in the corresponding feather planting groove 231Q of the connecting member 23Q. It is worth mentioning that the feather planting arrangement 20Q further comprises a cluster of feather planting tubes 24Q. Each artificial rod 50Q penetrates the corresponding feather planting tube 24Q, so that each feather planting tube 24A retains the corresponding artificial rod 50Q in position.

Referring to FIG. 24 of the drawings, the structure of the feather planting arrangement 20R of this alternative mode is similar to the structure of the feather planting arrangement 20Q shown in FIG. 23. According to this alternative mode, the artificial rods 50Q are omitted, the shaft member of each feather unit 30R is directly planted in the feather planting groove 231R of the connecting member 23R of the feather planting arrangement 20R.

Embodiment 7

Figure 25:
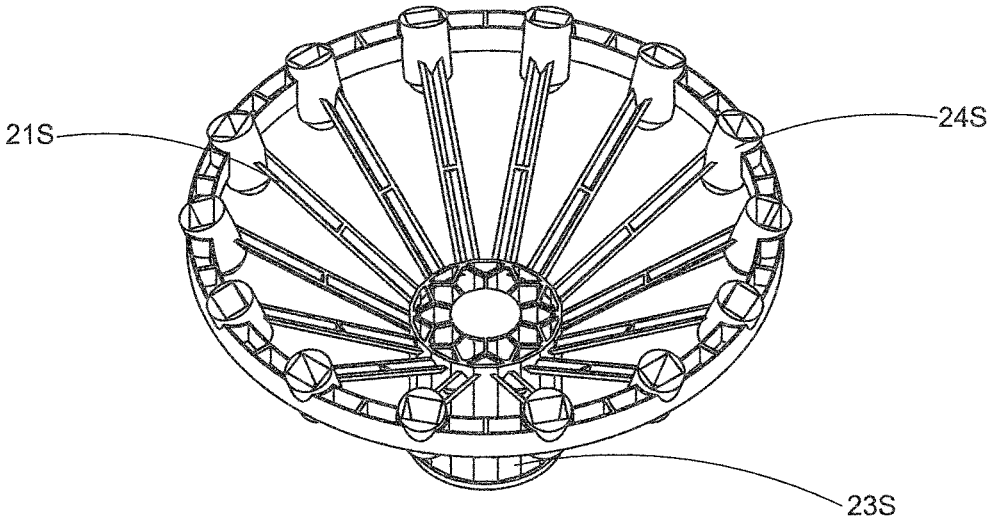
FIGS. 25 to 30 are schematic views illustrating a shuttlecock according to a seventh preferred embodiment of the present invention.
Figure 26:
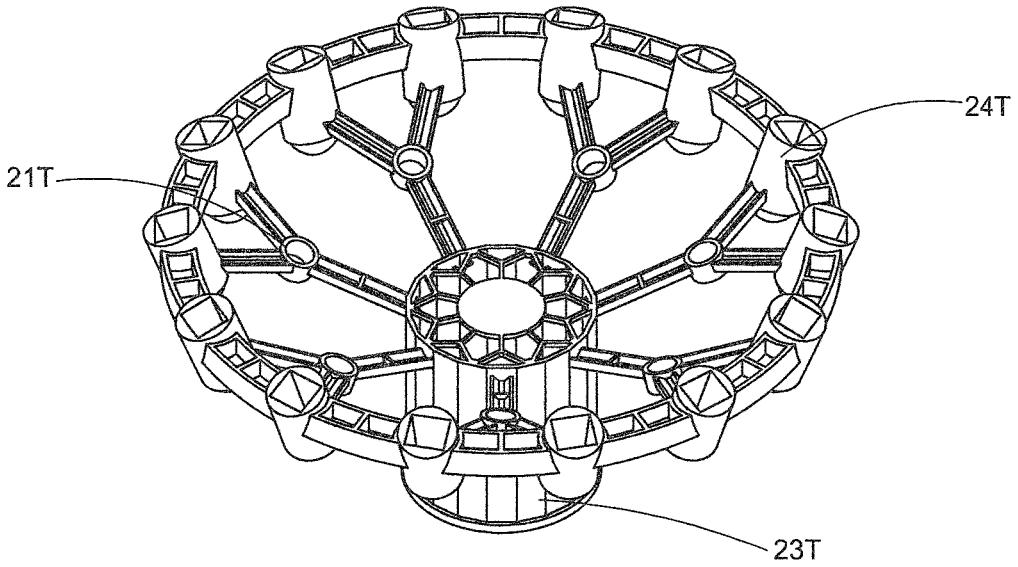
Figure 27:
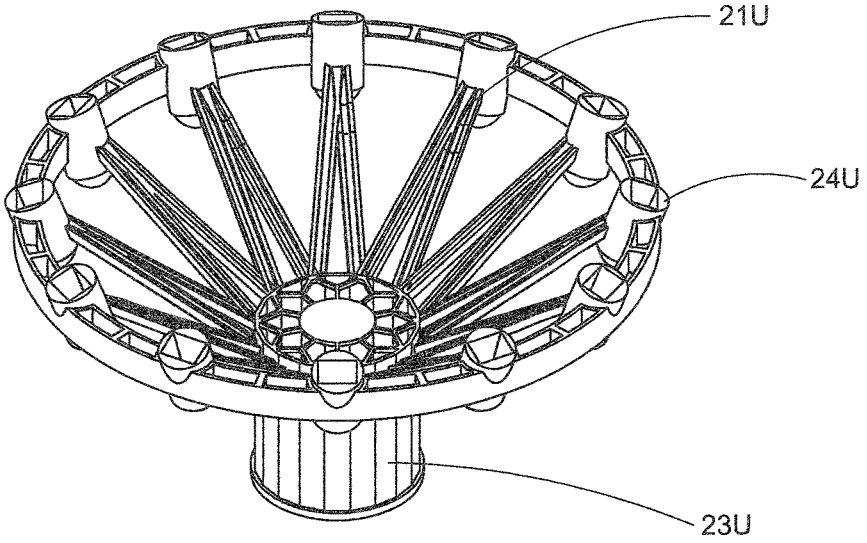
Figure 28:
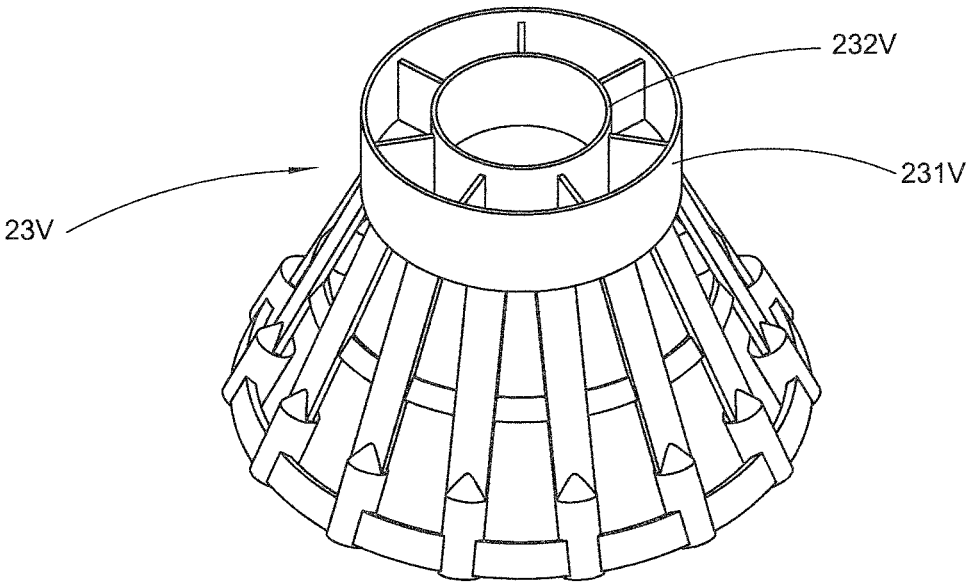
Figure 29:
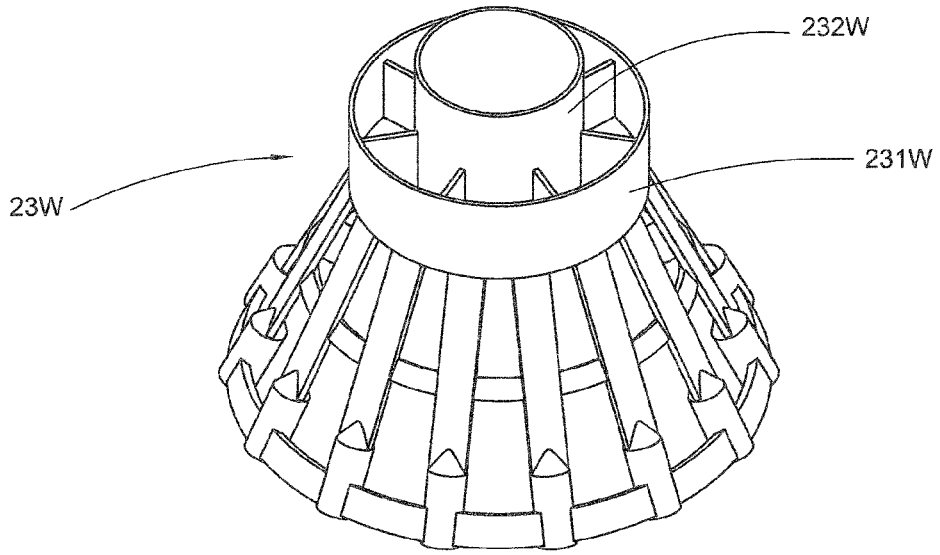
Figure 30:
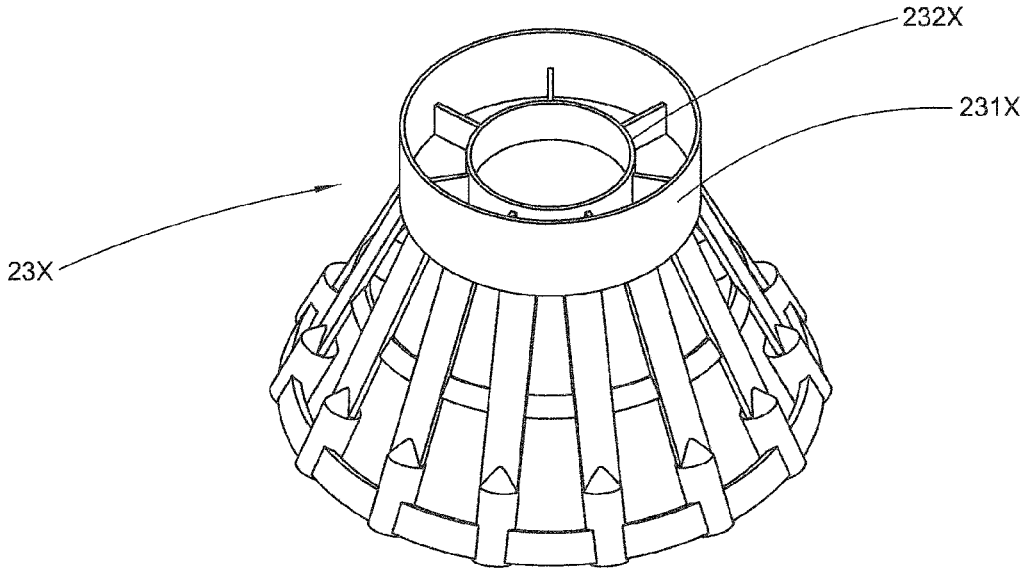

FIGS. 25 to 30 are schematic views illustrating the alternative modes of the connecting element of the feather planting arrangement. As shown in FIGS. 25 to 27 of the drawings, each connecting member 23S, 23T and 23U is embodied as a ring body for connecting with the shuttlecock head. Each feather planting tube 24S, 24T and 24U can be connected with the corresponding connecting member 23S, 23T and 23U via a various structures. It is worth mentioning that Each feather planting tube 24S, 24T and 24U can be connected with the corresponding connecting member 23S, 23T and 23U via the feather planting member 21S, 21T and 21U in a connecting manner which is not the same manner as the end-to-end manner of the above preferred embodiment. In other words, each feather planting member 21S, 21T and 21U is sidewardly extended from the corresponding feather planting tube 24S, 24T and 24U. Referring to FIGS. 28 to 30 of the drawings, each of the connecting member 23V, 23W and 23X comprises an outer cylindrical wall 231V, 231W and 231X, and an inner cylindrical wall 232V, 232W and 232X for connecting with the shuttlecock head.

It is worth mentioning that the number of the feather planting tubes is 10-20. Correspondingly, the number of the feather units is 10-20.

One skilled in the art will understand that the embodiment of the present invention as shown in the drawings and described above is exemplary only and not intended to be limiting.

It will thus be seen that the objects of the present invention have been fully and effectively accomplished. The embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. A shuttlecock, comprising:

a set of feather units each comprising a feather member and a shaft member extended from said feather member;

a shuttlecock head having at least one insertion groove; and a connecting arrangement, wherein each of said shaft member of said feather unit is planted at said connecting arrangement, wherein said connecting arrangement is inserted in said insertion groove of said shuttlecock head, wherein said connecting arrangement comprises a feather planting arrangement which comprises a set of feather planting members of a same number as a number of said feather units, wherein each of said feather planting members comprises a feather planting end portion and an insertion end portion, wherein an end portion of said shaft member of said feather unit is planted in said feather planting end portion of said feather planting member, wherein said insertion end portion of each of said feather planting members is inserted in said insertion groove of said shuttlecock head, wherein each of said feather planting end portions is provided with a feather planting groove for said shaft member to insert therein.

2. A shuttlecock, comprising:

a set of feather units each comprising a feather member and a shaft member extended from said feather member;

a shuttlecock head having at least one insertion groove; and a connecting arrangement, wherein each of said shaft member of said feather unit is planted at said connecting arrangement, wherein said connecting arrangement is inserted in said insertion groove of said shuttlecock head, wherein said connecting arrangement comprises a feather planting arrangement which comprises a set of feather planting members and a set of feather planting tubes each provided at an end portion of said feather planting member, wherein each of said feather planting tube is provided with a feather planting groove for insertion of said shaft member of said feather unit.

3. The shuttlecock, as recited in claim 2, wherein each of said feather planting member is coupled with said corresponding feather planting tube in an end-to-end manner.

4. The shuttlecock, as recited in claim 2, wherein said feather planting arrangement further comprises a set of side enhancing rib for supporting each of said corresponding feather planting tube.

5. The shuttlecock, as recited in claim 2, wherein said feather planting arrangement further comprises a set of double-side enhancing ribs for supporting each of said corresponding feather planting tube.

6. A shuttlecock, comprising:

a set of feather units each comprising a feather member and a shaft member extended from said feather member;

a shuttlecock head having at least one insertion groove; and a connecting arrangement, wherein each of said shaft member of said feather unit is planted at said connecting arrangement, wherein said connecting arrangement is inserted in said insertion groove of said shuttlecock head, wherein said connecting arrangement comprises a feather planting arrangement which comprises a set of feather planting members, wherein the number of said feather planting members is 10-20, the number of said corresponding feather units is 10-20.

* * * * *